US007382092B2

(12) United States Patent
Graf

(10) Patent No.: US 7,382,092 B2
(45) Date of Patent: Jun. 3, 2008

(54) ELECTRIC LAMP WHICH IS CLOSED AT ONE END

(75) Inventor: Jurgen Graf, Munich (DE)

(73) Assignee: Patent-Treuhand-Gesellshaft für elektrische Glühlampen mbH, Munich (DE)

( * ) Notice: Subject to any disclaimer, the term of this patent is extended or adjusted under 35 U.S.C. 154(b) by 372 days.

(21) Appl. No.: 11/185,941

(22) Filed: Jul. 21, 2005

(65) Prior Publication Data

US 2006/0028135 A1 Feb. 9, 2006

(30) Foreign Application Priority Data

Aug. 4, 2004 (DE) ..... 20 2004 012 220 U

(51) Int. Cl.
*H01J 61/30* (2006.01)
*H01J 5/50* (2006.01)

(52) U.S. Cl. ..... 313/567; 313/570; 313/572; 313/578; 313/332

(58) Field of Classification Search ..... None
See application file for complete search history.

(56) References Cited

U.S. PATENT DOCUMENTS 3,780,328 A * 12/1973 Boddy et al. ..... 313/579
4,354,137 A * 10/1982 Martin et al. ..... 313/579
5,932,955 A 8/1999 Berger et al.
5,986,404 A 11/1999 Dietze
5,986,405 A * 11/1999 De Maagt et al. ..... 313/637

FOREIGN PATENT DOCUMENTS

EP 0 780 883 6/1997
EP 0 923 109 6/1999

* cited by examiner

*Primary Examiner*—Ashok Patel
(74) *Attorney, Agent, or Firm*—William E. Meyer

(57) ABSTRACT

The bulb (1) of the lamp which defines a longitudinal axis (A) is closed at one end by a seal (3), contact elements being fitted to the one end which are each electrically conductively connected to a power supply line (2) leading to a luminous element, the contact element being accommodated in a tubular part (15) of the seal part, characterized in that the contact element (5) protrudes outwards and is equipped in the interior of the tubular part with at least two outwardly protruding centering parts (10, 11) which are in contact with the tubular extension (16).

7 Claims, 3 Drawing Sheets

A-A

ELECTRIC LAMP WHICH IS CLOSED AT ONE END

TECHNICAL FIELD

The invention relates to an electric lamp which is closed at one end having a bulb which is sealed in a vacuum-tight manner, defines a longitudinal axis and is closed at one end by a seal, contact elements being fitted to one end which are each electrically conductively connected to a power supply line leading to a luminous means, the contact element being accommodated in a tubular part of the seal part. Of concern here are, in particular, metal halide lamps or else halogen incandescent lamps.

BACKGROUND ART

U.S. Pat. No. 5,932,955 has already disclosed an electric lamp which is closed at two ends, two base parts having contact elements which rest in tubular extensions at the end of pinch seals having a sealing effect. The contact elements extend transversely with respect to the lamp axis and are surrounded by the tubular extensions in the form of sleeves. Fixing takes place along the circumference of the contact elements. One disadvantage of this is the fact that the contact elements can easily become skewed such that they are no longer precisely transverse with respect to the lamp axis and also such that the risk of breakage is relatively high.

U.S. Pat. No. 5,986,404 discloses a halogen incandescent lamp with a pinch seal at one end, in the case of which the contact pins are in the form of round sleeves.

DISCLOSURE OF THE INVENTION

It is the object of the present invention to provide an electric lamp which is closed at one end having a bulb which is sealed in a vacuum-tight manner, defines a longitudinal axis and is closed at one end by a seal , contact elements being fitted to one end which are each electrically conductively connected to a power supply line leading to a luminous means, the contact element being accommodated in a tubular part of the seal part, which is closed at one end and has a single contact pin, which lamp is mounted securely and provides effective sealing.

This object is achieved by the following features: the contact element protrudes outwards and is equipped in the interior of the tubular part with at least two outwardly protruding centering parts which are in contact with the tubular extension. Particularly advantageous refinements are described in the dependent claims.

The lamp which is closed at one end according to the invention has a bulb which is sealed in a vacuum-tight manner, defines a longitudinal axis and is closed at one end by a seal part, it being possible, but not absolutely necessary, for a base to be fitted at one end of the seal part. The power supply lines which protrude out of the seal, generally implemented in the form of a pinch seal, are equipped with contact pins which are connected in a simple manner to the power supply lines.

In principle, the above concept is suitable for many types of lamps, in particular for discharge lamps or incandescent lamps. The seal may be a pinch seal or a fused seal.

In a particularly preferred embodiment, the contact pin is a sleeve which has a slot running continuously along a main line or backbone or a partially slotted sleeve, in the case of which only an inner section is slotted.

This sleeve is preferably divided into two sections which bear against the power supply line with different degrees of tightness.

In particular, the sleeve is divided into a first section and a second section. The first section surrounds the power supply line as tightly as possible and does not protrude. It is therefore particularly suitable for making contact in a lampholder.

In contrast, the inner, second section is bent up and is thus anchored securely in the seal.

Typical applications are metal halide lamps and halogen incandescent lamps.

BRIEF DESCRIPTION OF THE DRAWINGS

The invention will be explained in more detail below with reference to a plurality of exemplary embodiments. In the drawings.

BEST MODE FOR CARRYING OUT THE INVENTION

Figure 1:
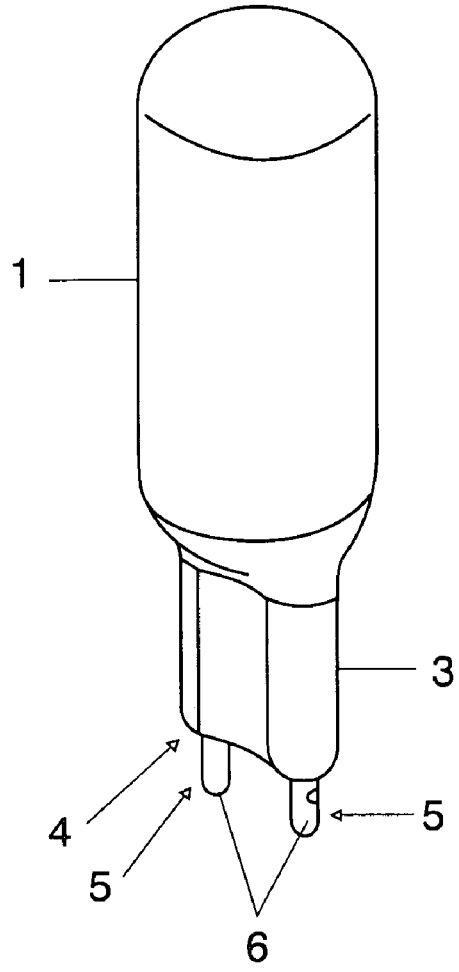
FIG. 1 shows a perspective view of a lamp.
Figure 2:
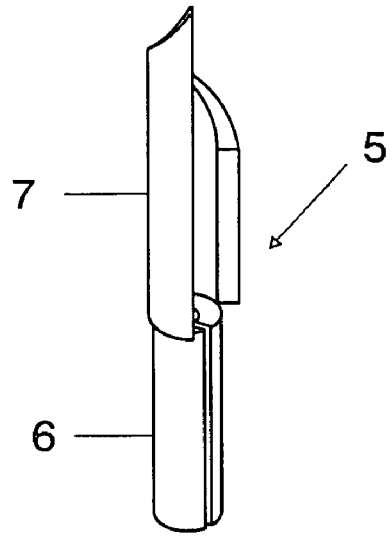
FIG. 2 shows a contact pin for the lamp shown in FIG. 1.

FIG. 1 shows the perspective view of a halogen incandescent lamp which has a pinch seal at one end. It comprises a cylindrical bulb 1 in which a luminous element is arranged (not shown).

Figure 3:
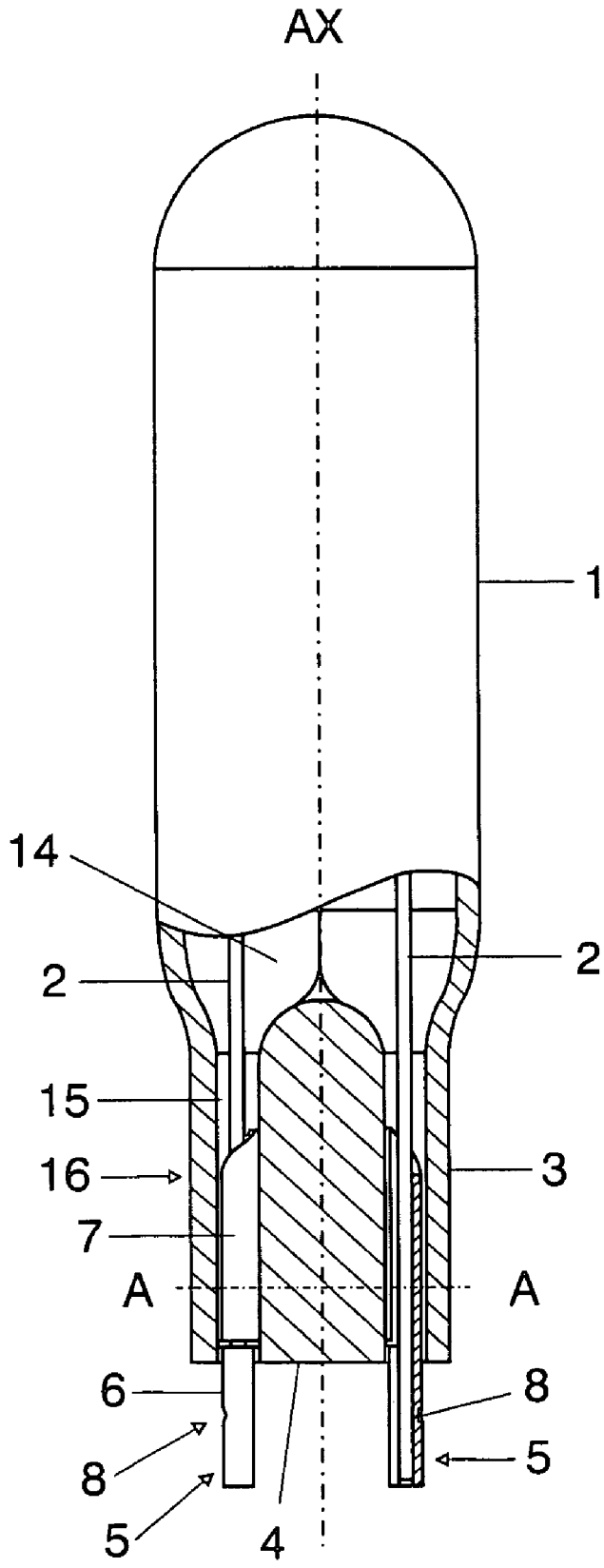
FIG. 3 shows a longitudinal section through the lamp shown in FIG. 1.
Figure 4:
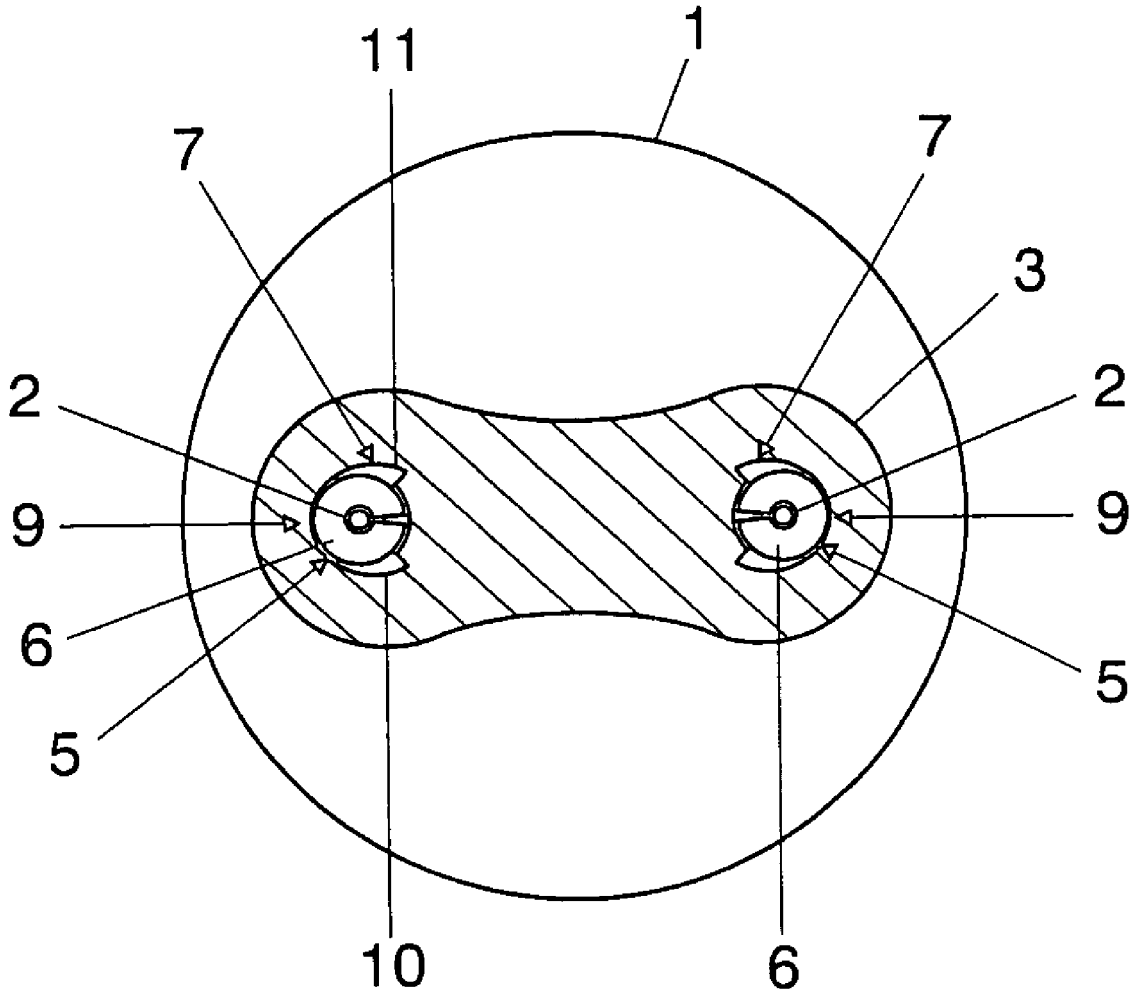
FIG. 4 shows a cross section through the pinch seal of the lamp shown in FIG. 1.

The luminous element (or else electrodes) is retained by two power supply lines 2, cf. FIG. 3, which are passed through a seal 3. The power supply lines 2 protrude outwards at the front end 4 of the seal. The power supply lines 2 are surrounded by a contact pin 5 in this region and in part of the seal. The seal comprises an actual seal part 14 and an extension 16 which has two tubular parts 15 in which the contact pins 5 are accommodated.

The contact pin 5 is a slotted sleeve which is divided into two sections. The first section 6 protrudes predominantly outwards out of the front end. It surrounds the power supply line 2 tightly with a press fit. The second section 7 has a common central line or backbone 9 which runs parallel continuously along the longitudinal axis of the lamp. However, the two open ends 10, 11 of the slot are bent up outwards and are as a result anchored securely in the seal.

The second section 7 occupies approximately 50 to 80% of the length of the seal. The inner end 12 of section 7 has a curved cut, which improves the sealing properties further still.

The angle which is formed between the open edges of the ends 10, 11 is preferably in the range from 70° to 120°.

The first section 6 is also connected to the power supply line 2 accommodated therein by means of a crimping connection 8.

The material of the bulb and of the power supply lines and contact pins should be matched to one another as well as possible in terms of their coefficients of thermal expansion. The materials which are used in the case of hard glass bulbs, which are pinch-sealed directly without foils, act as the guiding rule.

A typical example of this is described in EP-A 923 109. A suitable power supply line 2 is a wire made from molybdenum, tungsten or dumet (Fe/Ni). Suitable as the contact pin, whose diameter is considerably greater, is stainless steel, which is in particular austenitic or contains additions of Cr and/or nickel. The nickel material may also rest on a stainless steel core as a plating.

The ratio of the diameters of the contact pin and of the power supply line is considerably greater than 1 and is preferably in the range from 1.5 to 6.

What is claimed is:

1. An electric lamp comprising:

a tubular envelope defining a longitudinal axis and enclosing a luminous element that is sealed in the envelope in a vacuum-tight manner by a seal formed at one end of the envelope, the luminous element being electrically coupled by at least two contact elements extending into the seal, and at least one tubular part held at least in part in the seal, the tubular part defining an interior part and having a centering part that in part protrudes outwardly from the seal, wherein at least a portion of one of the contact elements is positioned in the interior part of the tubular part.

2. The lamp as claimed in claim 1, characterized in that centering part of the tubular part comprises a slotted sleeve.

3. The lamp as claimed in claim 2, characterized in that the tubular part comprise two sections, of which the first section tightly surrounds the contact element and protrudes outwards, and the second section protruding inwards includes an axially extending opening with a flared open edge that is accommodated in the interior of the seal.

4. The lamp as claimed in claim 1, characterized in that the lamp is a discharge lamp or an incandescent lamp.

5. The lamp as claimed in claim 2, characterized in that the tubular part is produced in one piece.

6. The lamp as claimed in claim 1, characterized in that the tubular part is produced predominantly from steel.

7. The lamp as claimed in claim 1, characterized in that the tubular part is fixed to the contact element by means of a crimping connection.

* * * * *